United States Patent [19]

Tolliver

[11] Patent Number: 4,689,867

[45] Date of Patent: Sep. 1, 1987

[54] CONCRETE REINFORCEMENT SPACER AND METHOD OF USE

[76] Inventor: Wilbur E. Tolliver, 364 Hamilton Dr., Holland, Mich. 49423

[21] Appl. No.: 739,769

[22] Filed: Jun. 3, 1985

Related U.S. Application Data

[62] Division of Ser. No. 423,557, Sep. 27, 1982, abandoned.

[51] Int. Cl.[4] ..... B23P 11/02; E04C 5/16

[52] U.S. Cl. ..... 29/453; 29/155 R; 52/655; 52/677; 52/687; 140/112; 249/91

[58] Field of Search ..... 52/652, 655, 664, 677, 52/678, 684–689, 741, 334, 337, 340; 404/35, 36; 29/155 R, 453; 140/112; 249/91; 264/69, 256, 333

[56] References Cited

U.S. PATENT DOCUMENTS

| | | | |
|---|---|---|---|
| 1,620,501 | 5/1927 | Vogel | 52/687 |
| 1,772,741 | 8/1930 | Barber | 52/652 |
| 1,930,957 | 10/1933 | Nester | 404/136 |
| 2,349,399 | 5/1944 | Awbrey | 52/687 |
| 2,420,860 | 5/1947 | Burner | 52/686 |
| 2,754,674 | 7/1956 | Malsbury et al. | 52/723 |
| 3,114,221 | 12/1963 | Eriksson | 52/684 |
| 3,400,508 | 9/1968 | Dietner et al. | 52/677 |
| 3,788,025 | 1/1974 | Holmes | 52/685 |
| 3,863,416 | 2/1975 | Oroschakoff | 52/646 |
| 4,034,529 | 7/1977 | Lampus | 52/687 |
| 4,270,583 | 6/1981 | Tolliver | 109/92.1 |
| 4,372,350 | 2/1983 | Schmidt et al. | 140/112 |

FOREIGN PATENT DOCUMENTS

| | | | |
|---|---|---|---|
| 634364 | 3/1963 | Belgium | 52/677 |
| 1509036 | 12/1968 | Fed. Rep. of Germany | 52/687 |
| 2143167 | 3/1973 | Fed. Rep. of Germany | 52/677 |
| 2363641 | 6/1975 | Fed. Rep. of Germany | 52/684 |
| 186761 | 8/1958 | Switzerland | 52/655 |
| 379733 | 8/1964 | Switzerland | 52/677 |
| 404153 | 6/1966 | Switzerland | 52/687 |
| 422278 | 4/1967 | Switzerland | 52/677 |

*Primary Examiner*—John E. Murtagh
*Assistant Examiner*—Andrew J. Rudy
*Attorney, Agent, or Firm*—Price, Heneveld, Cooper, DeWitt & Litton

[57] ABSTRACT

A welded wire concrete reinforcement spacer having spaced uprights with tops projecting up from the bottoms toward one another, a support means on the uprights and located below the tops of the uprights, the tops being spaced sufficiently to allow a reinforcement member to pass therebetween but spaced sufficiently close together as to prevent easy and accidental withdrawal of the reinforcement member from between the uprights.

The spacer can include a second support means for supporting a second reinforcement member, and the first support means can include a cross piece secured to and extending between the uprights, or a notch in the tops of the uprights. A concrete reinforcement spacer and reinforcement assembly is also included, as well as a method of use for the same.

3 Claims, 7 Drawing Figures

CONCRETE REINFORCEMENT SPACER AND METHOD OF USE

This is a division of application Ser. No. 423,557, filed Sept. 27, 1982, now abandoned.

BACKGROUND OF THE INVENTION

The present invention relates to concrete reinforcements, and in particular, to a device for spacing such concrete reinforcements and a method of use for the same. Typically, concrete structures are reinforced with some type of welded wire assembly which is suspended within the concrete. This wire assembly is normally spaced somewhat above the bottom of the concrete structure and often a second wire assembly is spaced above the first wire assembly in the concrete structure. These wire assemblies thus require a spacing device to hold the assemblies in position while the concrete is poured, this positioning device remaining in the structure once the concrete has hardened.

A very common type of spacer used to position such wire reinforcement assemblies is comprised of a small concrete block with a section of rebar protruding from the concrete block, the rebar being bent into an L-shape at its free end. These spacers are placed throughout the concrete structure and a first wire assembly is layed upon the concrete blocks of the spacers. A second wire reinforcement assembly is then placed upon the bent portion of the rebar to hold it at a distance above the first assembly. Use of such spacers poses several problems. One is that often the top wire assembly slides off of the rebar, requiring the top wire assembly to be tied to the rebar using a short twist of wire. The lower wire reinforcement assembly can also shift and slide off of the concrete base while the concrete is being poured. Since the rebar has an L-shape, the rebar acts as a moment arm allowing the spacer to tip over when the wire assembly is placed upon it.

In addition to the drawbacks of the tying being time consuming and the spacers having a lack of stability, spacers using a concrete base are heavy to handle and transport.

An example of such a spacer is disclosed in Malsbury, U.S. Pat. No. 2,754,674 which shows a rebar with a U-shaped bend at its free end, allowing two wire assemblies to be tied onto the bent area and a third assembly to be layed on the concrete base. Another type of spacer is disclosed in Barber, U.S. Pat. No. 1,772,741 which is comprised of inverted V-shaped saddles on which a reinforcing assembly rests. Another inverted "V" spacer with a rebar rod supports clip welded to its top is disclosed in Ericksson U.S. Pat. No. 3,114,221.

SUMMARY OF THE INVENTION

The spacer of the present invention comprises spaced uprights having tops projecting upwardly towards one another from bottoms spaced further apart. There is at least one support means on the uprights located below the tops of the uprights and above the bottoms whereby concrete reinforcement, such as a rebar or wire reinforcing mat having interconnected wires, can be supported between the uprights and above the bottom. The tops of the uprights are spaced sufficiently far apart to allow passage of the reinforcement between the tops and into position between the two uprights, but are sufficiently close together to generally trap the reinforcement between the uprights. In this manner, the reinforcement is not only supported above the bottom of the concrete form, but is also trapped in position on the spacer such that it cannot readily be knocked over or removed from the spacer. Yet, wire tying is not required in order to achieve this result.

These spacers are easy to use in that the reinforcement can simply be snapped into position, and once positioned, the spacer will not tip over. Since the spacers are comprised of a light bent wire, the spacers are easy to handle and transport.

These and other objects, advantages and features of the invention will be more fully understood and appreciated by reference to the written specification and appended drawings.

DESCRIPTION OF THE PREFERRED EMBODIMENT

Figure 2:
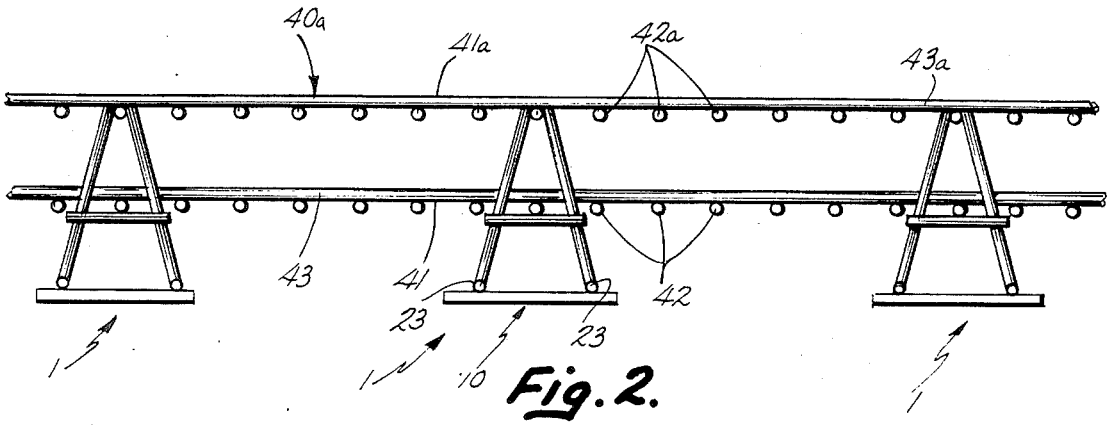
FIG. 2 is a front elevational view of the spacer supporting two sheets of reinforcement fabric.

For purposes of description herein, the terms upper, lower, rear, front, vertical, horizontal and derivatives thereof shall relate to the invention as oriented in Figs. 2 and 2. However, it is to be understood that the invention may assume various alternative orientations, except where expressly specified to the contrary.

Figure 1:
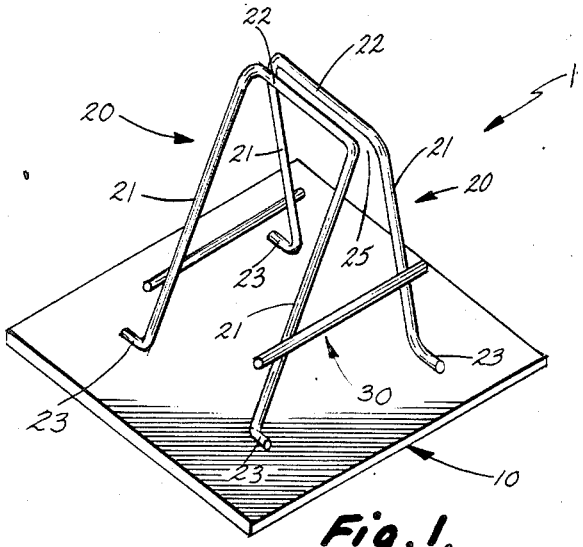
FIG. 1 is a perspective view of the reinforcement spacer of the present invention.
Figure 3:
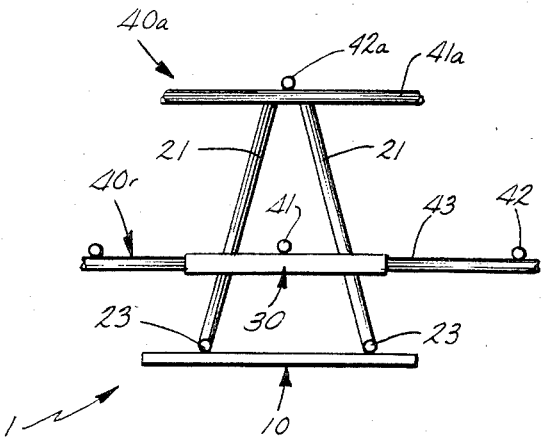
FIG. 3 is a front elevational view of the spacer supporting two sheets of fabric in inverted orientation relative fo FIG. 2.

In the preferred embodiment, the concrete reinforcement spacer 1 comprises two uprights 20 having tops 22 and bottoms 26 (FIGS. 1–3). Uprights 20 are joined by two cross pieces 30, giving the spacer an overall "A" configuration in front elevation. In embodiment 1, cross pieces 30 serve as a support means located below tops 22 of uprights 20, and above bottoms 26. Spacers 1 are used to support either a rebar or a wire concrete reinforcing mat comprised of a number of transversely interconnected wires 41. A first wire mat 40 is supported on the cross pieces 30 of a number of aforementioned spacers 1, and a second wire mat 40 is supported on tops 22 of these uprights 20.

For spacers which are to be used on grade, uprights 20 are attached to a spacer base 10. Spacer base 10 is a flat, rolled metal square platform of sufficient size to be stable when the spacer is supporting a wire mat 40 or rebar members. Two metal uprights 20 are welded to the base 10, at an angle such that the uprights form an inverted truncated "V" when viewed from the front. When viewed from the side it can be seen that each upright 20 is generally an inverted "U" shape, having two legs joined by a top 22. Legs 20 end in bent feet 23, which rest on and are welded to base 10. Each of two wire cross pieces 30 is welded to the opposed legs 21 of opposed uprights 20, joining the two uprights 20 and giving the spacer an "A" configuration when viewed from the front (FIGS. 2, 3). Cross pieces 30 maintain uprights 20 in this angled "A" configuration in applications which do not make use of base 10. Base 10 is not absolutely necessary where spacer 1 is to be positioned on a form.

There is a gap 25 between the tops 22 of the two uprights 20. Since the uprights 20 are made of resilient wire, gap 25 can be increased slightly and the tops 22 will still return to their original position.

Spacer 1 will support two wire concrete reinforcing mats 40. Each mat 40 is made up of a series of wires 41, these wires 41 being longitudinal concrete reinforcing wires 43 which are welded to transverse concrete reinforcing wires 42. The number and length of the transverse 42 and longitudinal 43 wires depend upon the size and configuration of the concrete structure to be reinforced. Although preferably the transverse 42 and longitudinal 43 wires are oriented perpendicular to each other so that the wire mat forms a grid of rectangular openings, other mat configurations can be used.

The spacer 1 is constructed so that a wire 41 from the mat 40 is slightly larger than the gap 25 between the tops 22 of the uprights. Since the uprights 20 are resilient, a wire 41 from the mat 40 can be pressed through the gap 25 and then rest upon and be supported by the cross pieces 30. It does not matter if the wire 41 supported by the cross pieces is a transverse 42 or a longitudinal 43 wire. Once the wire 41 is supported by the cross piece 30, it is confined betwen the two uprights 20, and cannot slide laterally (perpendicular to its longitudinal axis) off of the cross pieces 30. By sloping inwardly towards a point over the center of platform 10, uprights 20 help keep the center of gravity of the load imposed by mat 40 over the center of platform 10 so that spacer 1 will not tip over and displace the wire mat 40. In applications making use of sections of rebar instead of a wire mat, gap 25 is slightly wider to allow a section of rebar to spread tops 22 and pass through gap 25. A concrete reinforcement mat may be formed from criss-crossed rebar sections laid on top of one another, the rebar sections being secured together by spacers 1 or other means.

The tops 22 of the uprights 20 are generally horizontal elements and can support a second wire mat **40*a* or rebar. A wire 41*a* from the second wire mat 40*a* rests upon the tops 22 of the uprights 20, and can be affixed there by any of various means, such as tying the spacer 1 to the mat 40a** with a small wire twist.

Figure 4:
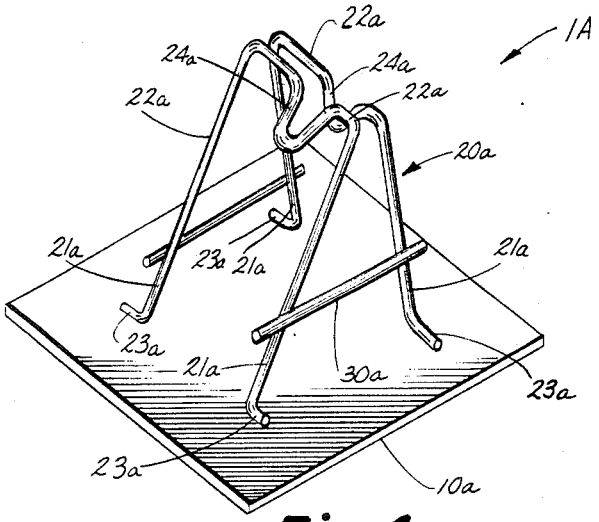
FIG. 4 is a perspective view of another embodiment spacer comprising the present invention.
Figure 5:
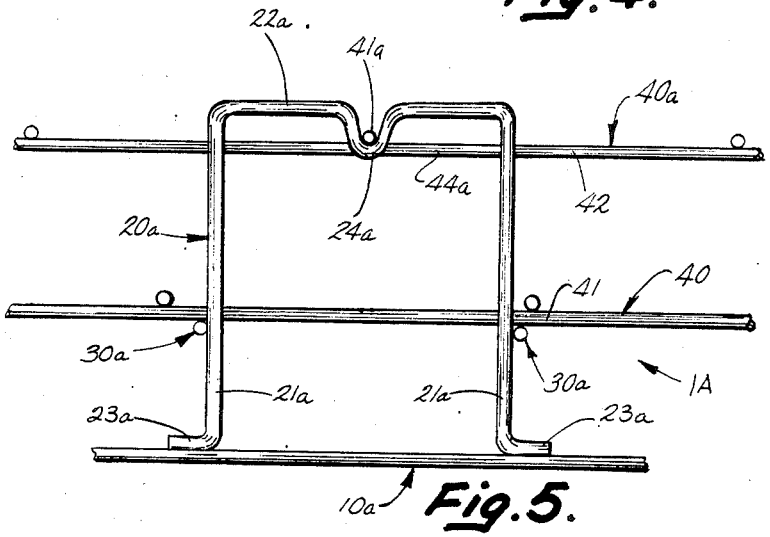
FIG. 5 is a side elevational view of the FIG. 4 embodiment spacer supporting two sheets of reinforcement.
Figure 6:
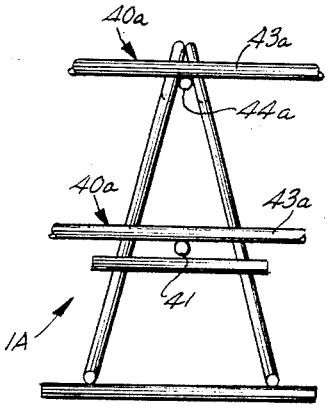
FIG. 6 is a front elevational view of the Figure 4 embodiment supporting two reinforcement assemblies.

As shown, a longitudinal wire **43*a* rests on tops 22 and a transverse wire 42*a* is shaped between tops 22. This is a preferred orientation, though the reverse shown in FIG. 3 is possible. The orientation of bottom mat 40 makes no difference, since movement by bottom mat 40 is equally restrained by spacer 1, without tying, in either orientation (compare FIGS. 2 and 3). In another embodiment of the invention, spacer 1A as shown in FIGS. 4, 5 and 6, the tops 22*a* of the uprights 20*a* contain notches 24*a*. Notch 24*a* is also a support means located below tops 22*a* and above bottoms 26*a* and base 10*a*. Notch 24 allows for a wire 41*a* from the second mat 40*a* to rest in the notches 24*a* and be restrained from lateral movement without the need for tying. Notches 24*a* are deep enough that a wire 44*a* of the second mat 40*a* that is perpendicular to wire 41*a* can pass through the gap 25*a* and be confined below the tops 22*a* of the uprights 20*a*. Thus the wire 44*a* is also restrained from lateral movement, fixing the second mat 40*a* on the spacer 1*a*. Due to the depth of notches 24*a* it does not matter if a transverse 42*a* or longitudinal wire 43*a* is supported in the notch, or whether the wire 44*a* perpendicular to wire 41*a* is oriented above or below wire 41*a***.

Figure 7:
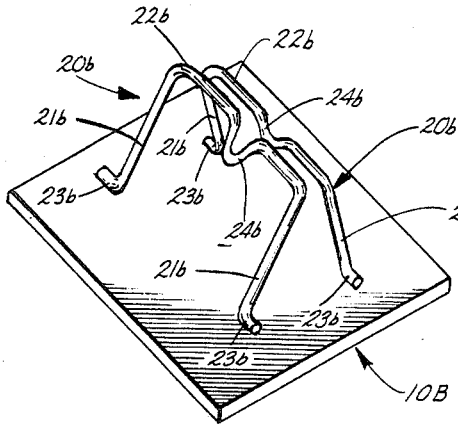
FIG. 7 is a perspective view of another embodiment of the invention for supporting a single reinforcing mat.

FIG. 7 shows another embodiment of the invention spacer **1*b* that will support a single wire mat. The spacer 1*b* has a platform 10*b* on which are attached two upright assemblies 20*b* at an angle such that the uprights 20*b* form an inverted "V" when viewed from the front. These uprights are an inverted "U" shape when viewed from the side, having two legs 21*b* and a top 22*b*. The legs 21*b* end at bottoms 26*b* in feet 23*b* which are welded to the base 10*b*. In the tops 22*b* are two support notches 24*b*, which will support a wire 41 of the reinforcing mat 40. This notched top spacer 1*b* operates in the same manner as the notched top portion 24*a* of spacer 1*a*** above described.

Cross pieces such as 30 and **30*a* in embodiments 1 and 1*a* are eliminated, at least on the shorter versions. This spacer 1*b* is designed to support only a single mat 40. On taller versions, cross pieces 30 and 30*a*** are still necessary to make the assembly sturdy, even though only a single mat will be supported.

In use, a number of spacers 1 are distributed throughout a concrete form. The number and locations of the spacers 1 will be determined by the configuration of the concrete structure, but a sufficient number of spacers should be used to prevent the wire mats 40 from sagging excessively. A first wire mat 40 of the desired size is then placed on the spacers 1. A wire 41 from the wire mat 40 is pressed through the gap 25 between the uprights 20 of each spacer 1, thus allowing the wire 41 to rest on and be supported by the cross pieces 30. A second wire mat **40*a* is then placed upon the spacers 1 by supporting a wire 41*a* from the second wire mat 40*a* on the tops 22 of the uprights 21 of each spacer 1. The second wire mat 40*a* is then secured to the tops 22 of the uprights 20. In using a spacer 1*a*, having a notch 24*a* in the tops 22*a* of the uprights 21*a*, a wire 44*a* from the second wire mat 40*a* is pressed through the gap 25*a* between the tops 22*a* of the uprights 20*a*, the spacer 1*a* being positioned so that a wire 41*a* perpendicular to wire 44*a* of the second wire mat 40*a* will be supported in the notch 24*a*. In using a single wire mat spacer 1*b*, a single wire mat 40*b* is placed on the spacers 1*b* and locked in the notch 24*b* as in the manner described above. It is to be understood that it is not necessarily the same wire 41 from mat 40 that is supported by all of the spacers, but can be different ones. Thus, spacers 1, or 1*a* or 1*b*** can be randomly distributed.

In all the embodiments of the present invention, the particular wire supported by the spacer 1 is unimportant, since the spacer can be positioned to support either a transverse wire 42 or a longitudinal wire 43 of wire mat 40.

Of course, it is understood that the above are merely preferred embodiments of the invention and that various alternatives and modifications can be made without departing from the spirit and broader aspects of the invention as set forth in the claims, such as a change in the configuration of the uprights, the type of base, or method of attaching the various elements together.

The embodiments of the invention in which an exclusive property or privilege is claimed are defined as follows:

1. A method for reinforcing concrete comprising:

positioning a plurality of spacers throughout a concrete form;

providing each spacer with a base platform, a pair of inverted, generally U-shaped spaced uprights and a pair of lateral cross supports extending between said uprights, each of said uprights comprising a metal rod bent into said generally U-shaped configuration so as to define a pair of spaced legs joined by an upper top member, said legs being secured at their bottoms to said platform, said uprights being inclined at an angle towards one another so that they are relatively close together at said top members and are spaced farther apart at the bottoms of said legs, said lateral cross supports being secured to and extending between opposed legs on adjacent uprights at a point spaced below said top members whereby in side elevation, the spacers have a generally "A" shaped configuration;

spacing said tops of said uprights sufficiently far apart to allow passage therebetween of a reinforcement rod therebetween and into a position between said spaced uprights, supported by said cross supports, but sufficiently close together so as to prevent easy or accidental withdrawal of said reinforcement rod from between said uprights;

supporting a first reinforcement mat on said spacers, said first mat comprising a plurality of generally parallel rods joined at generally right angles to a second plurality of generally parallel rods, by inserting one of said rods at each said spacer through said spacing at the tops of said uprights and into position resting on said cross supports;

supporting a second mat on said spacers, said second mat also comprising a plurality of generally parallel rods joined at generally right angles to a second plurality of generally parallel rods, by supporting one of said rods at each of said spacers on said tops of said uprights.

2. A method as described in claim 1 wherein said supporting step further includes, providing said spacers with a notch in each of said tops of sufficient depth such that when positioning a rod of said second mat within said notches another generally perpendicular rod is positioned between said uprights.

3. A method as described in claim 1 wherein said supporting step further includes, providing said spacers in which said uprights are resilient, forcing apart said tops by insertion of a rod therebetween, until said tops snap back toward one another to trap said rod beteen said uprights.

* * * * *